US007520599B2

(12) United States Patent
Okazaki et al.

(10) Patent No.: US 7,520,599 B2
(45) Date of Patent: Apr. 21, 2009

(54) INK-JET RECORDING APPARATUS

(75) Inventors: Naoya Okazaki, Gifu-ken (JP); Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 401 days.

(21) Appl. No.: 11/390,360

(22) Filed: Mar. 28, 2006

(65) Prior Publication Data

US 2006/0221148 A1 Oct. 5, 2006

(30) Foreign Application Priority Data

Mar. 31, 2005 (JP) ..... 2005-100747
Sep. 15, 2005 (JP) ..... 2005-268067

(51) Int. Cl.
*B41J 2/175* (2006.01)

(52) U.S. Cl. ..... 347/84; 347/85

(58) Field of Classification Search ..... 347/84, 347/85, 86, 87
See application file for complete search history.

(56) References Cited

U.S. PATENT DOCUMENTS 3,941,149 A * 3/1976 Mittleman ..... 137/493.1
4,514,742 A * 4/1985 Suga et al. ..... 347/85
4,677,447 A 6/1987 Nielsen ..... 347/87
5,040,002 A * 8/1991 Pollacek et al. ..... 347/87
6,193,364 B1 * 2/2001 Iida ..... 347/86
6,390,611 B1 * 5/2002 Kobayashi et al. ..... 347/84
6,666,551 B2 * 12/2003 Kobayashi et al. ..... 347/86
6,837,575 B2 * 1/2005 Usui ..... 347/85
6,929,357 B2 * 8/2005 Qingguo et al. ..... 347/85

FOREIGN PATENT DOCUMENTS

JP H62231759 10/1987
JP 2004268448 9/2004

* cited by examiner

*Primary Examiner*—Anh T. N. Vo
(74) *Attorney, Agent, or Firm*—Baker Botts, LLP

(57) ABSTRACT

An ink-jet recording apparatus includes a recording head, an ink channel supplying the recording head with ink and a valve body controlling the supply of ink to the recording head in the ink channel. The ink channel has a valve accommodation room and a valve opening formed in a wall surface located at one end of the valve accommodation room. In an ordinary state the valve body is urged to be in contact with the wall surface and to close the valve opening. In that state, a first area of the valve body, on which a pressure in a direction of opening the valve body from the valve opening acts, is smaller than a second area of the valve body, which is on an opposite side to the first area and on which a pressure within the valve accommodation room acts.

14 Claims, 4 Drawing Sheets

INK-JET RECORDING APPARATUS

CROSS REFERENCE TO RELATED APPLICATION

This application claims priority from Japanese Patent Applications No. 2005-100747, filed on Mar. 31, 2005, and No. 2005-268067, filed on Sep. 15, 2005, the entire subject matter of which are incorporated herein by reference.

TECHNICAL FIELD

Aspects of the present invention relate to an ink-jet recording apparatus. In particular, the invention relates to an ink-jet recording apparatus which is equipped with a device for suppressing variation of the pressure of ink supplied to a recording head.

BACKGROUND

In ink-jet recording apparatus, ink is supplied to a recording head by connecting an ink tank to the recording head detachably or by connecting an ink tank provided outside a carrier to a recording head on a carriage via a flexible ink tube.

To maintain good performance of ink ejection from the recording head, it is necessary to keep the ink pressure in the recording head almost constant.

JP-A-62-231759 discloses a technique in which an inverted-umbrella-shaped check valve is disposed between an ink tank and a recording head which is provided under the ink tank. When ink droplets are ejected from the recording head, the check valve is opened due to a pressure reduction on the recording head side and ink is thereby supplied from the ink tank.

In tube-supply-type ink-jet recording apparatus, recording is performed as the carriage mounted with the recording head is reciprocated along a guide rod. Therefore, the force of inertia acts on the ink in the ink tube as the carriage is accelerated or decelerated, as a result of which a pressure variation occurs in ink supplied to the recording head.

One measure which is employed to solve the above problem is to absorb a pressure variation by changing the volume of a buffer room provided in part of an ink channel on the carriage by, for example, forming one side of the buffer room with a flexible film or storing air in the buffer room. JP-A-2004-268448 proposes a technique in which a communication hole is formed at the center of a movable valve. In an ordinary state, the communication hole is located at the same position as the ink channel to enable supply of ink to the recording head. While the carriage is accelerated or decelerated, the communication hole is deviated from the ink channel due to the inertia of the movable valve and the ink supply is thereby restricted.

SUMMARY

In the structure disclosed in JP-A-62-231759, the weight of the ink in the ink tank is supported by the almost entire top surface of the check valve and the check valve is opened by a negative pressure on the recording head side. Therefore, the check valve itself needs to be formed with such a highly elastic material as to be able to sustain the ink weight, and hence the check valve is hard to respond to a small pressure variation on the recording head side. It is therefore difficult to keep the recording-head-side ink pressure constant.

In the technique in which the volume of the buffer room is changed, to enhance the pressure variation absorption effect, it is necessary to set the area of the flexible film large or to set the air volume larger than a prescribed value. This is problematic in miniaturizing the device. In the technique disclosed in JP-A-2004-268448 in which the movable valve is moved in the carriage movement direction due to its inertia, a space is necessary which allows the movable valve to move in both of the right and left directions with respect to the communication hole as the carriage is reciprocated. This is also problematic in miniaturizing the device.

Aspects of the present invention provides an ink-jet recording apparatus capable of suppressing pressure variation of ink in a recording head by means of a small and simple structure.

According to an aspect of the invention, there is provided an ink-jet recording apparatus including: a recording head which performs recording on a recording medium by ejecting ink droplets from ink ejection apertures; an ink channel which supplies the recording head with ink that is supplied from an ink supply source; and a valve body which controls the supply of ink to the recording head in the ink channel, wherein the ink channel has a valve accommodation room which accommodates the valve body in a movable manner, a valve opening opened and closed by the valve body is formed in a wall surface which is located at one end of the valve accommodation room in a movement direction of the valve body, and the valve opening and the valve accommodation room are connected to the ink supply source and the recording head, respectively; in an ordinary state the valve body is urged to be located at a position where it is in contact with the wall surface and to close the valve opening, and defines, with the wall surface, a space which is independent of the valve opening and the valve accommodation room; and when the valve body is opened by a pressure reduction in the valve accommodation room due to ejection of ink droplets from the recording head, a pressure in the space acts to move the valve body in such a direction as to open the valve opening.

In the ink-jet recording apparatus, in an ordinary state the valve body is urged so as to be located at a position where to close the valve opening. The valve opening is opened when the pressure in the valve accommodation room is lowered due to discharge of ink droplets from the recording head. When the valve body is located at the closing position, a space which is independent of the valve opening and the valve accommodation room is formed between the valve body and the valve accommodation room. Since the pressure in the space acts to move the valve body in such a direction as to open the valve opening, the speed of the response of the valve body to a pressure variation in the valve accommodation room can be increased. As a result, pressure variation of the ink in the recording head is suppressed, whereby the ink discharge performance of the recording head is almost constant and high-quality recording is enabled.

Further, since the movement range of the valve body is defined only by the closing position and the opening position, the device can be made small.

BRIEF DESCRIPTION OF THE DRAWINGS

Illustrative aspects of the invention may be more readily described with reference to the accompanying drawings.

DETAILED DESCRIPTION

Figure 1:
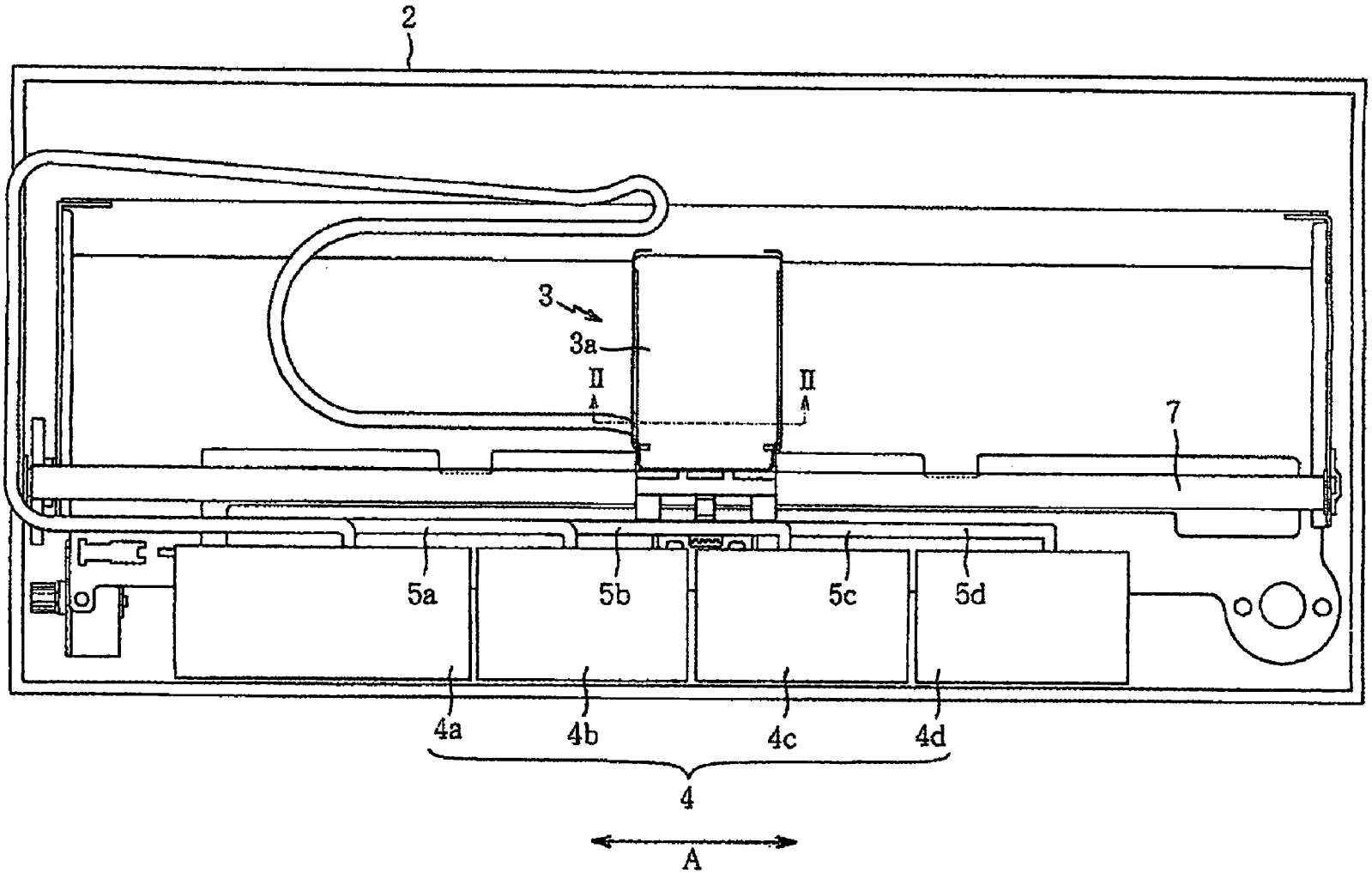
FIG. 1 is a plan view of an ink-jet recording apparatus according to an aspect of the present invention.

Aspects of the present invention will be hereinafter described with reference to the drawings. As shown in FIG. 1, an ink-jet recording apparatus 1 is equipped with a recording apparatus main body 2 which is generally box-shaped, a recording head unit 3 which is mounted inside the recording apparatus main body 2, ink tanks 4*a*-4*d* (ink supply sources), and ink tubes 5*a*-5*d* (flexible ink supply members) for supplying inks from the ink tanks 4*a*-4*d* to the recording head unit 3.

The recording head unit 3 is mounted on a carriage 3*a*, and the carriage 3*a* is supported by a guide rod 7 so as to be movable in a direction A which is perpendicular to a recording medium transport direction. As is known, the carriage 3*a* is reciprocated across a recording medium by a belt which is driven by a motor.

The ink tanks 4, which store inks to be supplied to the respective recording heads, are disposed stationarily outside the carriage 3*a*, for example, under the recording medium transport path. The ink tanks 4 are four ink tanks 4*a*-4*d* which are arranged in the movement direction of the carriage 3*a* and contain black, yellow, cyan, and magenta inks, respectively. The ink tanks 4 supply inks to the recording head unit 3 via the respective ink tubes 5*a*-5*d*.

Figure 2:
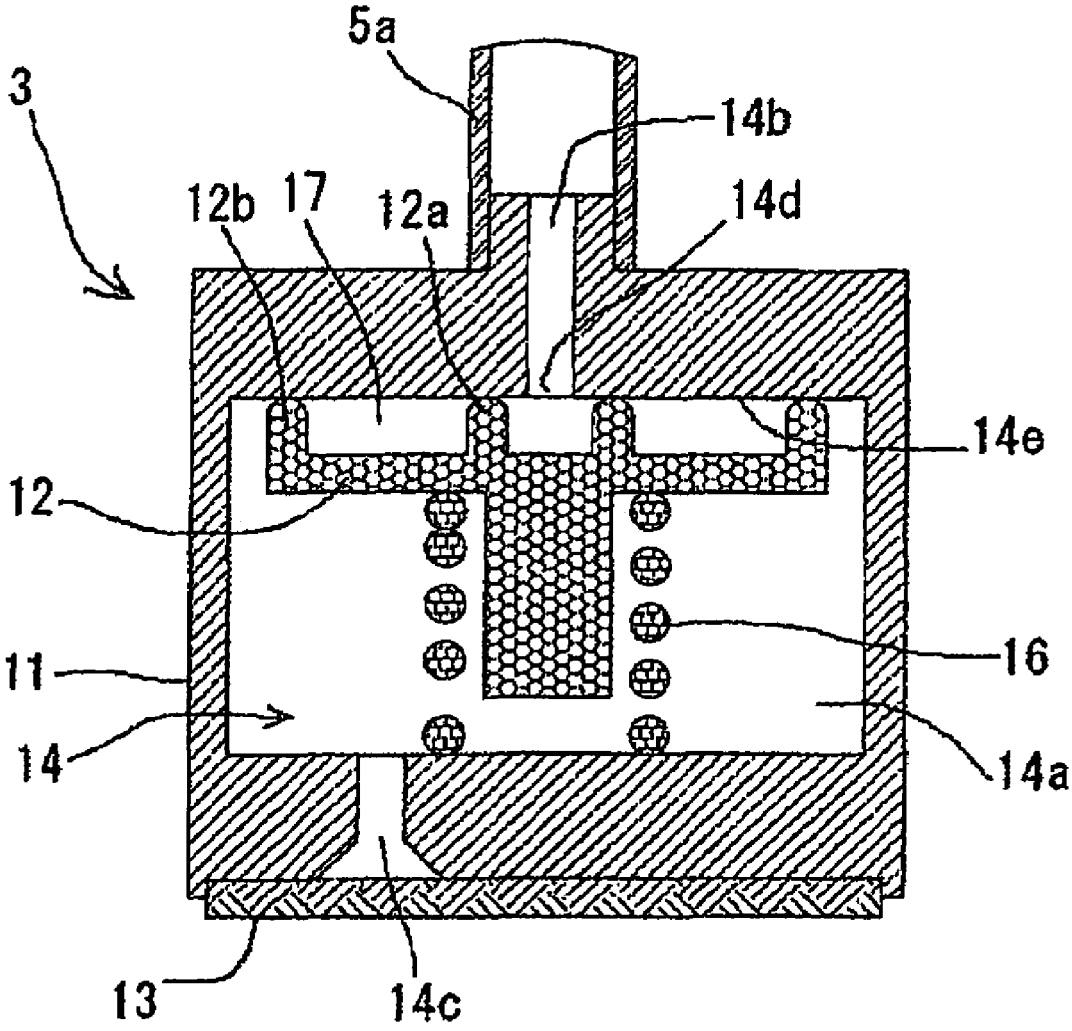
FIG. 2 is a sectional view of a recording head unit taken along line II-II in FIG. 1.

As shown in FIG. 2, the recording head unit 3 is equipped with a channel body 11 having ink channels 14 inside as well as with four recording heads 13 (only one of which is shown) which correspond to the above-mentioned inks of the four colors and are attached to the bottom surface, to be opposed to a recording medium, of the channel body 11. Each recording head 13 is the same in configuration as conventional ones in having plural pressure rooms (not shown) and plural ink ejection apertures (not shown) which correspond to the respective pressure rooms and are located at the bottom. Each recording head 13 ejects ink droplets downward from the ink discharge apertures when driven by pressure generating members such as piezoelectric elements or heating resistor elements.

Although the four ink channels 14 are arranged so as to correspond to the respective recording heads 13, only one ink channel 14 is shown in FIG. 2 because they have the same structure. The ink channel 14 is composed of a valve accommodation room 14*a* which is formed inside the channel body 11 and has a center axis extending perpendicularly to the carriage movement direction, an introduction passage 14*b* which communicates with one end, in the center axis direction, of the valve accommodation room 14*a* via a valve opening 14*d*, and an output passage 14*c* which communicates with the valve accommodation room 14*a* at a position that is distant from the introduction passage 14*b* in the center axis direction. The output passage 14*c* communicates with the recording head 13 and supplies ink to it.

The introduction passage 14*b* communicates with the ink tank 4*a* via the ink tube 5*a*. As shown in FIG. 1, the ink tubes 5*a*-5*d* are led out of the carriage 3*a* in the carriage movement direction.

A valve body 12 is accommodated in the valve accommodation room 14*a* in such a manner that a gap that allows an ink flow is formed outside the outer circumferential surface of the valve body 12, whereby the valve body 12 is movable in the center axis direction. The valve body 12 is always urged in the center axis direction by a spring 16 which is accommodated in the valve accommodation room 14*a*. In an ordinary state, the valve body 12 is in contact with a valve-opening-14*d*-side wall surface 14*e* of the valve accommodation room 14*a* and thereby closes the valve opening 14*d*.

Figure 3:
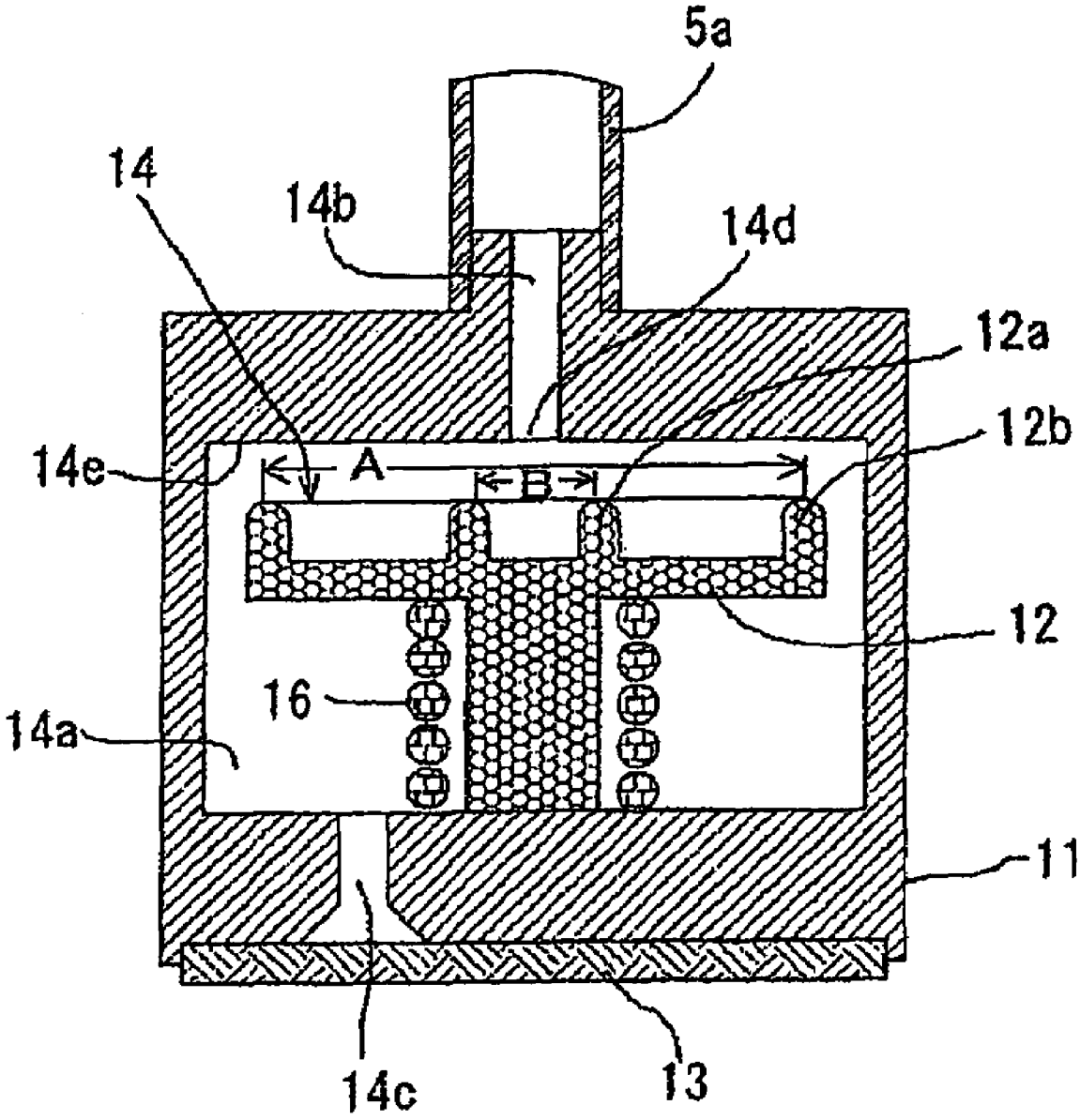
FIG. 3 is a view corresponding to FIG. 2 and illustrating an operation.

When the ink in the valve accommodation room 14*a* is consumed by ejection of ink droplets from the recording head 13 and the pressure of the space in the valve accommodation room 14*a* thereby becomes lower than a prescribed value, as shown in FIG. 3 the valve body 12 is moved against the urging force of the spring 16, whereby the valve opening 14*d* is opened and ink is supplied from the ink tank 4*a*. The pressure in the valve accommodation room 14*a* is kept constant in this manner. The urging force of the spring 16 is set so that the pressure of ink that is supplied from the valve accommodation room 14*a* to the recording head 13 becomes an approximately constant negative pressure (what is called a back pressure) that is lower than atmospheric pressure.

That surface of the valve body 12 which is opposed to a valve-opening-14*d*-side wall surface 14*e* of the valve accommodation room 14*a* has double ribs 12*a* and 12*b* which are like concentric rings and project toward the wall surface 14*e*. The ribs 12*a* and 12*b* have rubber-like elasticity and also serve as sealing members when they are brought into contact with the wall surface 14*e* of the valve accommodation room 14*a* by the urging force of the spring 16. The inside rib 12*a* comes into contact with the wall surface 14*e* of the valve accommodation room 14*a* so as to surround the valve opening 14*d*. The outside rib 12*b* comes into contact with the wall surface 14*e* of the valve accommodation room 14*a* so as to be spaced from the inside rib 12*a* in the radial direction. In a state that the inside and outside ribs 12*a* and 12*b* are in contact with the wall surface 14*e*, a closed space 17 is formed between the ribs 12*a* and 12*b* so as to be independent of the valve opening 14*d* and the valve accommodation room 14*a*.

Therefore, between an area B, which is on the inner side of a location at which the inside rib 12*a* abuts on the wall surface 14*e*, and an area A, which is on the inner side of a location at which the outside rib 12*b* abuts on the wall surface 14*e*, the following relationship is established: A>B. On the area B of the valve body 12 that is orthogonal to the opening direction (moving direction) thereof, the pressure of ink acts in the direction of opening the valve body 12 from the valve opening 14*d*. Also, when the pressure of the valve accommodation room 14*a* decreases as ink therein is consumed, the pressure of ink acts on the area A as well in the direction of opening the valve body 12. That pressure is exerted on the area A from the inner side of the accommodation room 14*a*. Since the area A is larger than the area B, the valve body 12 is easily opened against the urging force of the spring 16 in response to the pressure variation within the valve accommodation room 14*a*.

The response relative to the pressure variation within the tube (ink supply member) 5*a* is suppressed so that the pressure variation within the valve accommodation room 14*a* is suppressed.

Since the valve accommodation room 14*a* is filled with ink, the space 17 between the both ribs 12*a*, 12*b* is filled with ink even when the valve body 12 is brought into contact with the wall face 14*e* of the valve accommodation room 14*a*. The ink pressure of the space 17 between the both ribs 12*a*, 12*b* is substantially the same as that of the valve accommodation room 14*a* immediately before the valve body 12 comes into contact with the wall face 14*e*. When the valve opening 14*d* is opened, the ink pressure within the tube 5*a* acts on the valve body 12. Thus, the ink pressure within the space 17 is substantially the same as that within the tube 5*a*, that is, substantially the same as the atmospheric pressure. After the valve body 12 closes the valve opening 14*d*, the pressure within the valve accommodation room 14*a* decreases in accordance with the ink ejection, and thus the ink pressure within the space 17 becomes relatively high compare to the pressure within the valve accommodation room 14*a*.

The pressure of the ink confined between the ribs 12*a* and 12*b* acts in such a direction as to open the valve opening 14*d* together with the pressure due to the difference between the areas A and B. Therefore, the urging force of the spring 16 for urging the valve body 12 toward the position where the valve body 12 is to close the valve opening 14*d* can be made weaker (than in the case where the measure of confining ink between the ribs 12*a* and 12*b* is not taken). As a result, the speed of the response of the valve body 12 to a pressure variation in the valve accommodation room 14*a* can be increased. The pressure variation in the recording head 13 can be reduced and its ink ejection performance can be kept almost constant.

Since as described above the valve body 12 is movable in the direction perpendicular to the movement direction of the carriage 3*a*, the valve opening 14*d* is closed by the urging force of the spring 16 irrespective of the movement direction of the carriage 3*a*.

When the carriage 3*a* is accelerated leftward in FIG. 1, that is, in the direction in which the tube 5*a* is led out, the ink in the tube 5*a* flows toward the carriage 3*a* because of its inertia and thereby increases the pressure in the introduction passage 14*b*. When the carriage 3*a* is accelerated rightward in FIG. 1, that is, in the direction opposite to the direction in which the tube 5*a* is led out, the ink in the tube 5*a* flows away from the carriage 3*a* because of its inertia and thereby decreases the pressure in the introduction passage 14*b*. However, in either case, the valve body 12 keeps the valve opening 14*d* in the closed state because of the urging force of the spring 16 and thereby prevents the high pressure or low pressure in the introduction passage 14*b* from influencing the recording head 13. As a result, pressure variation of the ink in the recording head 13 is suppressed and the ink pressure in the recording head 13 is kept almost constant. The ink discharge performance of the recording head 13 is kept good and high-quality recording is enabled.

According to the above-described aspect, when the valve body 12 comes into contact with the wall surface 14*e* again after being separated from the wall surface 14*e*, part of ink that has been located in the valve accommodation room 14*a* is confined in the space 17 between the valve body 12 and the wall surface 14*e*. At this time, the pressure in the space 17 is approximately equal to the pressure of the ink that has flown into the valve accommodation room 14*a* from the ink supply source. The difference between the pressure in the valve accommodation room 14*a* and the pressure in the space 17 facilitates movement of the valve body 12 and thereby increases the response speed of the valve body 12.

Since the space 17 between the valve body 12 and the wall surface 14*e* is formed annularly so as to surround the valve opening 14*d*, the pressure in the space is exerted uniformly on the entire valve body 12. Also, the space 17 can be given a large area relative to the valve opening 14*d*. The valve body 12 is thereby allowed to operate smoothly and easily.

The valve body 12 has two ring-shaped ribs 12*a*, 12*b* which are spaced from each other and serve as sealing members when in contact with the wall surface 14*e*, and the space 17 is formed between the two ribs when the two ribs come in contact with the wall surface 14*e*. Thus, the space 17 can be secured with a simple structure.

Also, the valve body 12 which is urged so as to be located at the closing position restricts an ink pressure variation that would otherwise be transmitted from the tube 5*a* to the recording head 13 as the carriage 3*a* is moved. As a result, the ink ejection performance is kept almost constant and high-quality recording is enabled.

Further, the valve body 12 is movable in a direction perpendicular to a movement direction of the carriage 3*a*. Therefore, the valve 12 is urged so as to be located at the closing position irrespective of the movement direction of the carriage 3*a*. The pressure in the valve accommodation rooms 14*a* can thus be kept almost constant.

Furthermore, the recording head 13 is fixed to a channel body 11 which has the ink channel inside. Therefore, the device can be made small.

Figure 4:
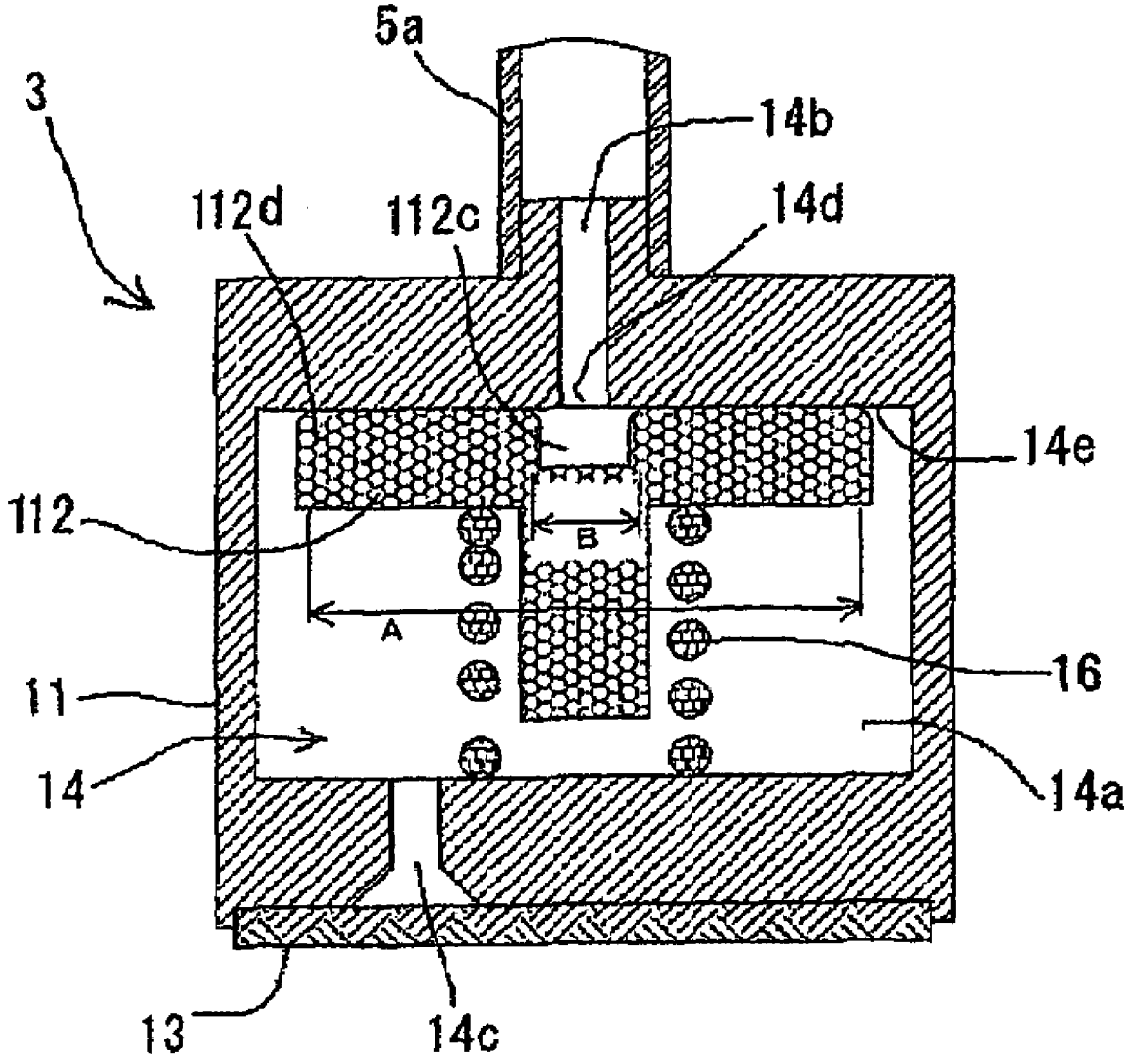
FIG. 4 is a view corresponding to FIG. 2 and illustrating another aspect of the present invention.

FIG. 4 shows an another aspect of the invention. The ribs 12*a*, 12*b* of the above-described aspect is eliminated from a valve body 112 of this aspect. A flat surface 112*d* comes into contact with the wall face 14*e*. A recess 112*c* is formed on the center of the surface so as to face to the valve opening 14*d*. The configuration of the valve accommodation room 14*aa* and the spring 16 is the same as that of the above-described aspect.

Between an area B surrounded by an inner peripheral portion of the surface 112*d* being in contact with the wall face 14*e* and an area A surrounded by an outer peripheral portion of the surface 112*d*, the following relationship is established: A>B. As the lowered pressure within the valve accommodation room 14*a* acts on the large area A, the valve body 12 is opened in good response to the pressure variation within the valve accommodation room 14*a*, in the same manner as the above-described aspect.

Although the above aspect is such that in an ordinary state the valve opening 14*d* is closed completely by the valve body 12, 112, a modification is possible in which even in a closed state a very narrow channel is left so that ink can be supplied at a very low rate with a large channel resistance. Further, the space 17 between the ribs 12*a* and 12*b* may be formed in the wall surface 13*e*, opposed to the valve body 12, of the valve accommodation room 14*a* instead of the valve body 12.

What is claimed is:

1. An ink-jet recording apparatus comprising:

a recording head which performs recording on a recording medium by ejecting ink droplets from ink ejection apertures;

an ink channel which supplies the recording head with ink that is supplied from an ink supply source; and a valve body which controls the supply of ink to the recording head in the ink channel, wherein the ink channel has a valve accommodation room which accommodates the valve body in a movable manner, a valve opening opened and closed by the valve body is formed in a wall surface which is located at one end of the valve accommodation room in a movement direction of the valve body, and the valve opening and the valve accommodation room are connected to the ink supply source and the recording head, respectively; in an ordinary state the valve body is urged to be located at a position where the valve body is in contact with the wall surface and to close the valve opening, and defines, with the wall surface, a space which is independent of the valve opening and the valve accommodation room; and when the valve body is opened by a pressure reduction in the valve accommodation room due to ejection of ink droplets from the recording head, a pressure in the space acts to move the valve body in such a direction as to open the valve opening.

2. The ink-j et recording apparatus according to claim 1, wherein when the valve body comes into contact with the wall surface again after being separated from the wall surface, part of ink that has been located in the valve accommodation room is confined in the space.

3. The ink-jet recording apparatus according to claim 1, wherein the space defined by the valve body and the wall surface is formed annularly so as to surround the valve opening.

4. The ink-jet recording apparatus according to claim 3, wherein the valve body has two ring-shaped ribs which are spaced from each other and serve as sealing members when in contact with the wall surface, and the space is formed between the two ribs when the two ribs come in contact with the wall surface.

5. The ink-jet recording apparatus according to claim 1, further comprising:

a carriage which is mounted with the recording head and is reciprocated; and a flexible ink supply member which supplies ink from the ink supply source provided outside the carriage toward the recording head, wherein the valve body is urged so as to restrict an ink pressure variation transmitted from the ink supply member to the recording head as the carriage is moved.

6. The ink-jet recording apparatus according to claim 5, wherein the valve body is movable in a direction perpendicular to a movement direction of the carriage.

7. The ink-jet recording apparatus according to claim 1, wherein the recording head is fixed to a channel body which has the ink channel inside.

8. An ink-jet recording apparatus comprising:

a recording head which performs recording on a recording medium by ejecting ink droplets from ink ejection apertures;

an ink channel which supplies the recording head with ink that is supplied from an ink supply source; and a valve body which controls the supply of ink to the recording head in the ink channel, wherein the ink channel has a valve accommodation room which accommodates the valve body in a movable manner, a valve opening opened and closed by the valve body is formed in a wall surface which is located at one end of the valve accommodation room in a movement direction of the valve body, and the valve opening and the valve accommodation room are connected to the ink supply source and the recording head, respectively; in an ordinary state the valve body is urged to be located at a position where the valve body is in contact with the wall surface and to close the valve opening; and in a state where the valve body is in contact with the wall surface, a first area of the valve body, on which a pressure in a direction of opening the valve body from the valve opening acts, is smaller than a second area of the valve body, which is on an opposite side to the first area and on which a pressure within the valve accommodation room acts.

9. The ink-jet recording apparatus according to claim 8, wherein the valve body comprises a first portion which abuts on the wall surface and surrounds the valve opening and a second portion which abuts on the wall surface while surrounding an area larger than that surrounded by the first portion.

10. The ink-jet recording apparatus according to claim 9, wherein the first portion is surrounded by the second portion; and a space which is independent of the valve opening and the valve accommodation room is defined between the first portion and the second portion when the first portion and the second portion abut on the wall surface.

11. The ink-jet recording apparatus according to claim 9, wherein the valve body comprises a surface located between the first portion and the second portion, the surface coming into contact with the wall surface when the first portion and the second portion abut on the wall surface.

12. The ink-jet recording apparatus according to claim 8, further comprising:

a carriage which is mounted with the recording head and is reciprocated; and a flexible ink supply member which supplies ink from the ink supply source provided outside the carriage toward the recording head, wherein the valve body is urged so as to restrict an ink pressure variation transmitted from the ink supply member to the recording head as the carriage is moved.

13. The ink-jet recording apparatus according to claim 12, wherein the valve body is movable in a direction perpendicular to a movement direction of the carriage.

14. The ink-jet recording apparatus according to claim 8, wherein the recording head is fixed to a channel body which has the ink channel inside.

* * * * *